US007262560B2

(12) United States Patent
Jaffar et al.

(10) Patent No.: US 7,262,560 B2
(45) Date of Patent: Aug. 28, 2007

(54) REGULATING A LIGHT SOURCE USING A LIGHT-TO-FREQUENCY CONVERTER

(75) Inventors: Rizal Jaffar, Melaka (MY); Kevin Len Li Lim, Perak (MY); Joon Chok Lee, Sarawak (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 288 days.

(21) Appl. No.: 10/854,128

(22) Filed: May 25, 2004

(65) Prior Publication Data

US 2005/0276033 A1 Dec. 15, 2005

(51) Int. Cl.
*G05F 1/00* (2006.01)

(52) U.S. Cl. ..... 315/291; 315/307; 345/102

(58) Field of Classification Search ..... 315/307–308, 315/291, 224, 225, 247, 246, 312; 345/87, 345/102, 204, 84, 89, 214; 362/84, 85
See application file for complete search history.

(56) References Cited

U.S. PATENT DOCUMENTS 3,611,086 A * 10/1971 Mokrytzki et al. ..... 363/37
3,921,012 A * 11/1975 Marshall, III ..... 327/101
5,698,952 A * 12/1997 Stebbins ..... 315/307
5,892,585 A * 4/1999 Lianza et al. ..... 356/405
6,894,464 B2 * 5/2005 Zhang ..... 323/268
2002/0036608 A1 * 3/2002 Hirakata et al. ..... 345/87
2004/0051692 A1 * 3/2004 Hirakata et al. ..... 345/102
2004/0105264 A1 * 6/2004 Spero ..... 362/276
2004/0179003 A1 * 9/2004 Jang ..... 345/204
2004/0232853 A1 * 11/2004 Hur et al. ..... 315/291
2004/0239262 A1 * 12/2004 Ido et al. ..... 315/291

* cited by examiner

*Primary Examiner*—Trinh Dinh
*Assistant Examiner*—Tung Le

(57) ABSTRACT

An apparatus and method thereof for regulating a light source are described. The apparatus includes a light-to-frequency converter that converts light received from the light source into a signal having a corresponding frequency. A circuit coupled to the light-to-frequency converter uses the frequency to regulate light that is emitted from the light source.

9 Claims, 2 Drawing Sheets

REGULATING A LIGHT SOURCE USING A LIGHT-TO-FREQUENCY CONVERTER

FIELD

Embodiments of the present invention relate to the regulation of light sources.

BACKGROUND

In a back-lighting application, one or more light emitting diodes (LEDs) provide illumination to a light guide or light pipe. A display such as a liquid crystal display (LCD) is placed over the light guide and is thereby illuminated.

White LEDs emit light that appears white to an observer and can be used for back-lighting. Red, green and blue LEDs can be used in combination to produce many colors and intensities of light for color displays as well as white light for back-lighting.

Controlling the brightness of the LED(s) is important so that there is enough illumination to make visible the information being displayed by the LCD. With the use of multiple, different-colored LEDs, controlling the brightness of the LEDs is also important in order to achieve proper color balance.

In general, a conventional light source controller employs a feedback loop that measures the voltage produced by the light received from the light source (e.g., an LED) and adjusts the light source accordingly. Conventional controllers include a sensor that converts the light from the light source into a voltage. The controller can also include a low-pass filter, a buffer/gain amplifier, and an analog-to-digital converter (ADC) to convert the measured voltage into a digital signal. The digital signal is received by a signal processor that determines whether the light source needs to be adjusted (e.g., made more or less brighter). The processor controls a pulse width modulation generator that drives the brightness of the light source.

Conventional controllers are problematic for a number of reasons. The low-pass filter, buffer/gain amplifier and ADC increase the size of the integrated circuit die, which can increase costs. Also, the low-pass filter, buffer/gain amplifier and ADC can each introduce noise into the circuit, which can effect the granularity of control.

A controller that can reduce die size and noise would be advantageous. A controller that can provide those advantages and also reduce power consumption and response time would be even more advantageous.

SUMMARY

Embodiments of the present invention pertain to an apparatus and method thereof for controlling a light source. In one embodiment, the apparatus includes a light-to-frequency converter that converts light received from the light source into a signal having a corresponding frequency. A circuit coupled to the light-to-frequency converter uses the frequency to regulate light that is emitted from the light source. By converting light to frequency, the light source controller can be implemented digitally, reducing die size, noise, power consumption and response time.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to various embodiments of the invention, examples of which are illustrated in the accompanying drawings. The drawings referred to in this description should not be understood as being drawn to scale except if specifically noted.

Figure 1:
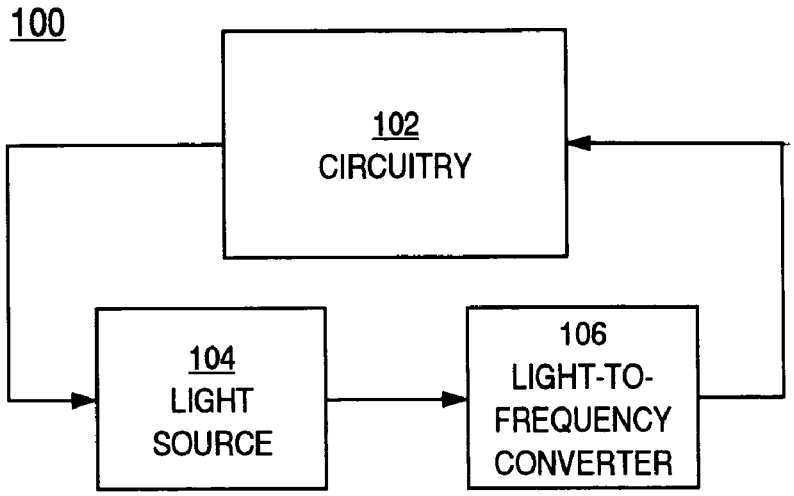
FIG. 1 is a block diagram of a device for regulating a light source according to one embodiment of the present invention.

FIG. 1 is a block diagram of a device 100 for regulating a light source 104 according to one embodiment of the present invention. Although the components of FIG. 1 are depicted as discrete components, the components can be implemented as a single integrated circuit device (e.g., a single integrated circuit die).

In the example of FIG. 1, a light-to-frequency converter 106 is positioned to receive the light emitted by light source 104, or some portion of that light. In general, light-to-frequency converter 106 converts the light it receives into a signal that has a frequency that corresponds to the brightness or intensity (e.g., color intensity) of light source 104. For example, the brighter the light source, the higher the frequency of the signal generated by light-to-frequency converter 106. In one embodiment, light-to-frequency converter 106 includes sensor (e.g., a photodiode) and a current-to-frequency converter (or a voltage-to-frequency converter).

In the present embodiment, circuitry 102 measures the frequency of the signal from light-to-frequency converter 106 and adjusts light source 104 accordingly. Additional information is provided in conjunction with FIG. 2 below.

In one embodiment, light source 104 is a light emitting diode (LED). Light-emitting devices other than LEDs can also be used. Light source 104 may be a source of white light, or it may be a source of colored light (e.g., red, green or blue). There may be multiple light sources. When there are multiple light sources, the circuitry 102 and light-to-frequency converter 106 can be replicated on a single integrated circuit die so that each light source can be independently regulated.

Light source 104 may include an array of red, green and blue LEDs, in which case light-to-frequency converter 106 can be adapted to detect the light brightness or intensity for each red, green and blue light coming from the light source. Different techniques can be employed to achieve this. In one embodiment, the light-to-frequency converter 106 includes an array of sensors (e.g., a photodiode array), and red, green and blue filters are positioned between the light source 104 and the sensor array so that some photodiodes only receive red light, other photodiodes only receive green light, and yet other photodiodes only receive blue light.

Figure 2:
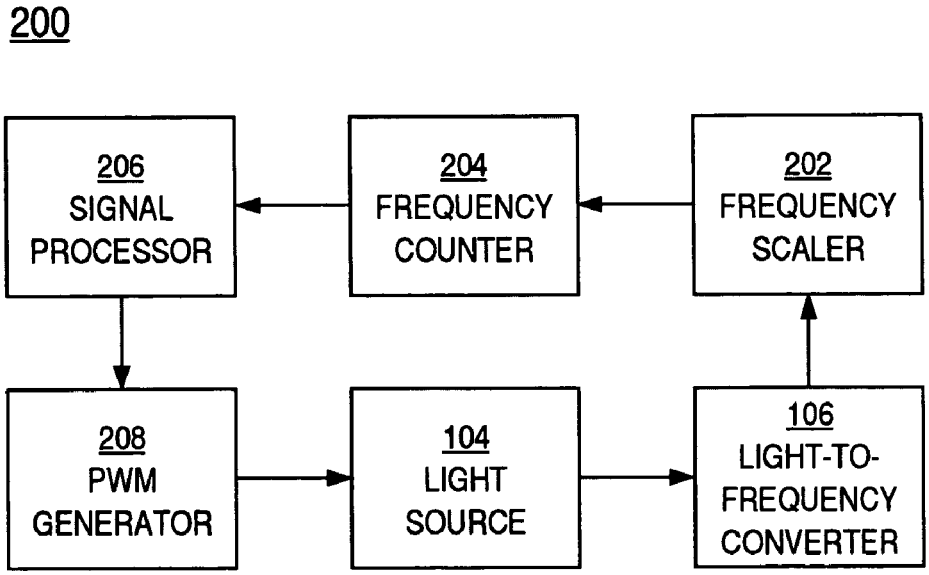
FIG. 2 is a block diagram showing circuit elements in a device for regulating a light source according to one embodiment of the present invention.

FIG. 2 is a block diagram showing elements that are included in circuitry 102 (FIG. 1) according to one embodiment of the present invention. In the example of FIG. 2, device 200 includes a frequency scaler 202 (e.g., a frequency multiplier), a frequency counter 204, a signal processor 206, and a pulse width modulator (PWM) generator 208.

In the example of FIG. 2, light-to-frequency converter 106 converts light received from light source 104 into a signal having a frequency. The frequency of the signal provides a measure of the brightness or intensity of the light source 104.

Frequency scaler 202 scales the frequency so that it is compatible with the range of frequency counter 204. For example, frequency scaler 202 can decrease the frequency of the incoming signal such that it is within the range of the frequency counter 204. Frequency counter 204 measures the frequency of the incoming signal and provides the frequency count to signal processor 206. In an alternative embodiment, the period of the incoming signal is determined and used instead of the frequency.

Signal processor 206 uses the information from frequency counter 204 to determine whether light source 104 should be adjusted. For example, a threshold value can be defined for the frequency or period. The threshold value can have an upper bound and a lower bound. Failure of the incoming signal frequency or period to satisfy the threshold value would indicate that adjustment of light source 104 may be needed.

Signal processor 206 controls PWM generator 208, which in turn drives light source 104. In one implementation, PWM generator 208 is a digital implementation that uses a free-running binary counter and a greater than (or less than) binary comparator. The comparator is fed the counter output (a binary number) and an amount of time (a binary number) that the PWM output is supposed to be high. The output of the comparator is high when the required amount of time is less than the counter value and low when it is greater than the counter value. Increasing the amount of time that the PWM output is supposed to be high will increase the PWM high output time and vice versa. In this manner, signal processor 206 regulates the brightness or intensity of light source 104.

In contrast to conventional controllers, device 200 is a digital implementation. By eliminating components such as an analog-to-digital converter, a low-pass filter, and a buffer/gain amplifier, device 200 takes up relatively less space on a die, providing more space for other components or allowing the die size to be reduced. Also, according to embodiments in accordance with the invention, noise is reduced, response time is faster, there is less signal loss, and less power is consumed.

Figure 3:
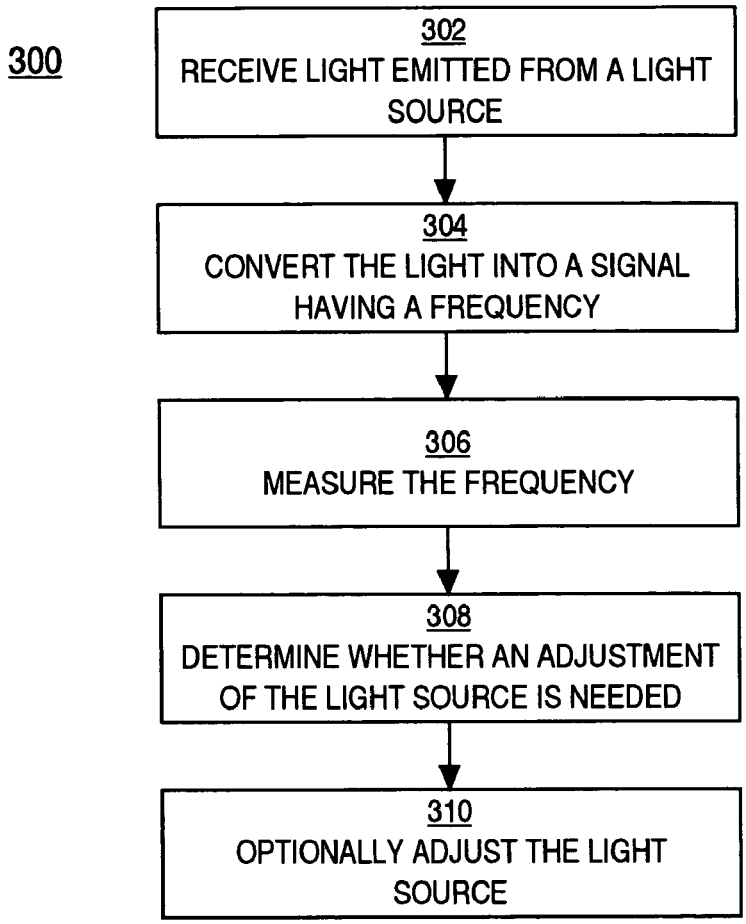
FIG. 3 is a flowchart of a method for regulating a light source according to one embodiment of the present invention.

FIG. 3 is a flowchart of a method 300 for regulating a light source according to one embodiment of the present invention. Although specific steps are disclosed in flowchart 300, such steps are exemplary. That is, embodiments of the present invention are well suited to performing various other or additional steps or variations of the steps recited in flowchart 300. It is appreciated that the steps in flowchart 300 may be performed in an order different than presented. In one embodiment, flowchart 300 is performed using device 200 of FIG. 2.

In step 302 of FIG. 3, with reference also to FIG. 2, light that is emitted from a light source (e.g., light source 104) is received at, for example, a sensor of a light-to-frequency converter (e.g., light-to-frequency converter 106).

In step 304 of FIG. 3, the light is converted into a first signal that has a frequency that corresponds to the output of the light source (e.g., the brightness or intensity of the light source).

In step 306, the frequency of the first signal is measured by a frequency counter (e.g., frequency counter 204 of FIG. 2). In one embodiment, a frequency multiplier (e.g., frequency scaler 202 of FIG. 2) adjusts the signal frequency to within the range of the frequency counter before the frequency is counted. Alternatively, the first signal can be oversampled to determine its period.

In step 308 of FIG. 3, depending on the frequency (or period) of the first signal, a determination is made (e.g., by signal processor 206 of FIG. 2) as to whether or not the light source needs adjustment.

In step 310 of FIG. 3, the light source is adjusted if required. In one embodiment, the light source is regulated by manipulating a second signal that drives the light source. The second signal can be viewed as the signal that is output from a processor (e.g., signal processor 206 of FIG. 2) and used to control a PWM generator (e.g., PWM generator 208 of FIG. 2). The control signal of the processor is manipulated according to the incoming signal from the frequency counter. Alternatively, the second signal can be viewed as the output signal of the PWM generator (e.g., PWM generator 208) that is used to regulate the light source. The output signal of the PWM generator is manipulated according to the control signal from the processor.

Figure 4:
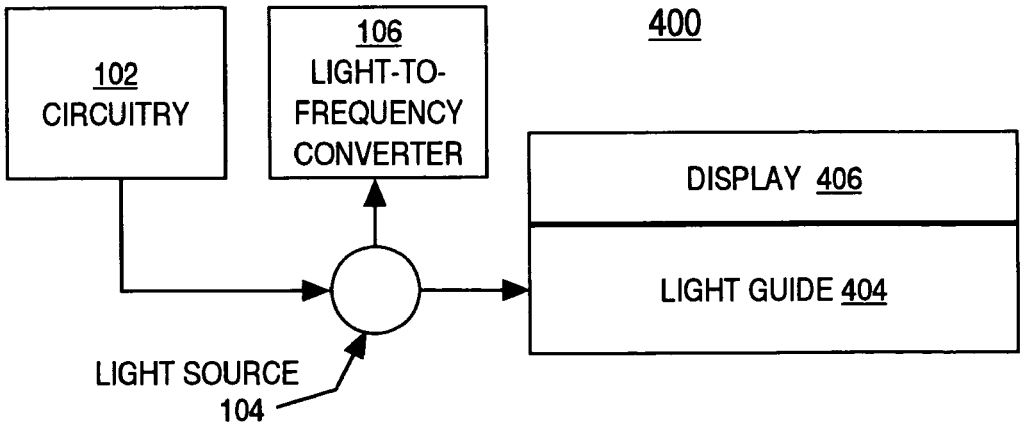
FIG. 4 is a block diagram of a back-lighting apparatus employing a device for regulating a light source according to one embodiment of the present invention.

FIG. 4 is a block diagram of a back-lighting apparatus 400 employing a device for regulating a light source (e.g., devices 100 and 200 of FIGS. 1 and 2, respectively) according to one embodiment of the present invention. In the example of FIG. 4, light from light source 104 provides illumination to a light guide 404 (also referred to as a light pipe). A display 406 (e.g., a liquid crystal display) is placed adjacent to (e.g., over) the light guide 404. The light from light source 104 is channeled along the length of light guide 404, and is reflected up and out of the light guide 404, thereby back-lighting the display 406. In the present embodiment, the brightness or intensity of light source 104 is regulated using light-to-frequency converter 106 and circuitry 102 as previously described herein.

Embodiments in accordance with the invention can be used to adjust a light source so that the color of the light produced by the light source matches an established color set point. Referring to FIGS. 1 and 2 above, consider an example in which light source 104 is an array of red (R), green (G) and blue (B) LEDs. A group of red LEDs, for instance, can be controlled through PWM such that their brightness ranges from zero (0) up to and including 100 percent. A group of green LEDs and a group of blue LEDs can be similarly controlled. The light output from the array of RGB LEDs is then mixed inside a light guide to produce a consistent color output.

Light-to-frequency converter 106, in essence, detects light intensity and converts that to an output frequency that is proportional to the detected light intensity. In the present example, in which light source 104 includes an array of RGB LEDs, light-to-frequency converter 106 is adapted to detect the light intensity for each red, green and blue light coming from the light guide. Different techniques can be employed to achieve this. In one embodiment, the light-to-frequency converter 106 includes an array of sensors (e.g., a photodiode array), and red, green and blue filters are positioned between the light guide and the sensor array so that some photodiodes only receive red light, other photodiodes only receive green light, and yet other photodiodes only receive blue light.

To generate a white color, for example, the red, green and blue intensities of the RGB LEDs are adjusted such that the combined light output is perceived as white by a human observer. The RGB LEDs can degrade over time and temperature, resulting in shifting from the desired white color point. For purposes of this discussion, assume that the red LEDs have degraded. This degradation is detected by the sensors as a change in the red intensity. The red LEDs are adjusted such that their intensity goes back to its previous value. In this manner, the desired white color point is maintained. Changes to the intensities of the green and blue LEDs can be handled in a similar manner.

The intelligence for the above is provided by signal processor 206. Signal processor 206 controls the mixture (or ratio) of red, green and blue light intensity in order to produce a desired color (e.g., white). Once signal processor 206 detects that the ratio is correct, it maintains that color point by continually evaluating the input from the sensors (e.g., from light-to-frequency converter 106) and comparing that input against an established set point. Signal processor 206 reduces or increases the brightness of the RGB LEDs to maintain the ratio at the established set point. Thus, the desired color (e.g., white) continues to be produced.

In summary, a desired color is selected, and the RGB LEDs are set up to produce that color (e.g., the proper ratio of RGB colors is initially set up to produce the desired color). The light-to-frequency converter 106 receives and converts each RGB light into a corresponding frequency that is proportional to the RGB light intensity. Signal processor 206 looks at the frequencies of the R light intensity, G light intensity and B light intensity, decides whether the ratio of frequencies is correct for the desired color, and makes any necessary corrections. Any long term degradation in the RGB LEDs is corrected by continually monitoring the LEDs in this manner.

Embodiments in accordance with the invention can also be used as part of a color balance system that is used, for example, in image processing to adjust the appearance of a captured image to more closely match the actual object being imaged. For instance, embodiments in accordance with the invention can be used to adjust a white back-light in a liquid crystal display (LCD) monitor, the white point of which can be adjusted automatically to maintain color balance.

In summary, embodiments of the present invention provide an apparatus and method thereof for controlling a light source using a light-to-frequency converter. By converting light to frequency, the light source controller can be implemented digitally, reducing die size, noise, power consumption and response time. Embodiments of the present invention are thus described. While the present invention has been described in particular embodiments, it should be appreciated that the present invention should not be construed as limited by such embodiments, but rather construed according to the following claims.

What is claimed is:

1. An apparatus comprising:

a light source;

a light guide between the light source and a display, the light guide arranged to channel and reflect the light from the light source;

a light-to-frequency converter that converts light received from said light source into a signal having a corresponding frequency; and a circuit coupled to said light-to-frequency converter, said circuit comprising a frequency scaler coupled between said light-to-frequency converter and a frequency counter, said frequency counter for determining the frequency of the signal, said frequency scaler for adjusting the frequency of the signal to within a range of the frequency counter, said circuit configured to regulate light emitted from said light source over the life of the display, wherein the light-to-frequency converter and the circuit are implemented on a single integrated circuit die.

2. The apparatus of claim 1 wherein said circuit regulates the brightness of said light.

3. The apparatus of claim 1 wherein said circuit controls a color produced by said light source.

4. The apparatus of claim 1 wherein said circuit comprises a signal processor, said signal processor using said frequency of said signal to determine whether to adjust said light source.

5. The apparatus of claim 1 further comprising a pulse width modulator generator that drives said light source.

6. The apparatus of claim 1 wherein said light source is used to back-light a display.

7. The apparatus of claim 1 wherein said circuit regulates light emitted from said light source by adjusting a second signal that drives the light source.

8. The apparatus of claim 7 wherein said second signal controls the color of light produced by said light source.

9. The apparatus of claim 7 wherein said second signal drives the intensity of light emitted from said light source.

* * * * *